United States Patent [19]

Theurer et al.

[11] Patent Number: 4,538,687

[45] Date of Patent: Sep. 3, 1985

[54] ARRANGEMENT FOR EXCAVATING AND CONVEYING BULK MATERIAL

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 525,652

[22] Filed: Aug. 23, 1983

[30] Foreign Application Priority Data

Sep. 20, 1982 [AT] Austria ..... 3504/82

[51] Int. Cl.[3] ..... E01B 27/11; E01B 29/05

[52] U.S. Cl. ..... 171/16; 198/604; 198/318; 104/2

[58] Field of Search ..... 171/16, 1; 104/7 R, 104/7 B, 2, 279; 198/317, 318, 604, 601

[56] References Cited

U.S. PATENT DOCUMENTS

| | | | |
|---|---|---|---|
| 1,148,954 | 8/1915 | Carr | 198/604 |
| 2,142,208 | 1/1939 | Protzeller | 171/1 |
| 3,356,157 | 12/1967 | Plasser et al. | 171/16 |
| 3,923,169 | 12/1975 | Drie | 198/604 |
| 4,043,398 | 8/1977 | Folser et al. | 171/16 |
| 4,152,989 | 5/1979 | Theurer et al. | 104/2 |

FOREIGN PATENT DOCUMENTS 970010 9/1964 United Kingdom .

*Primary Examiner*—Richard J. Johnson
*Attorney, Agent, or Firm*—Kurt Kelman

[57] ABSTRACT

In an arrangement for excavating bulk material and for conveying the excavated bulk material, which comprises a main endless excavating and conveying chain vertically adjustably mounted on a frame of a track maintenance machine, a polygonal guide for the chain, the guide including a transverse section operational below the track, an ascending longitudinal section leading from the transverse section, the transverse and ascending sections forming a transition zone, and a descending longitudinal section leading to the transverse section, and a drive for driving the endless chain in the polygonal guide, an auxiliary endless excavating and conveying chain in associated with the polygonal guide at least in the transition zone, and a separate drive is provided for the auxiliary endless chain.

10 Claims, 6 Drawing Figures

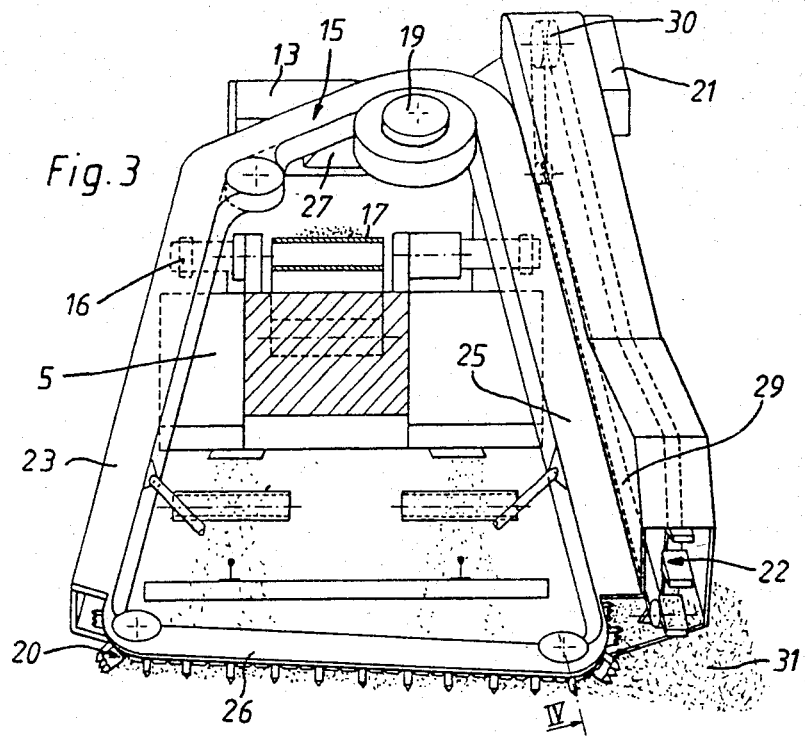
Fig. 5
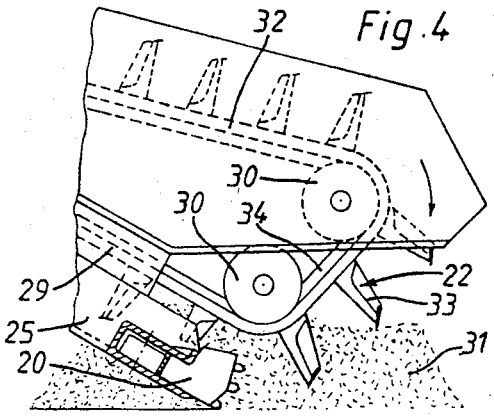
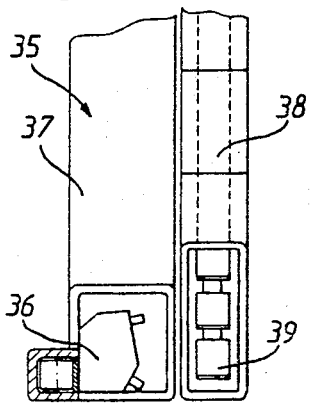
Fig. 6
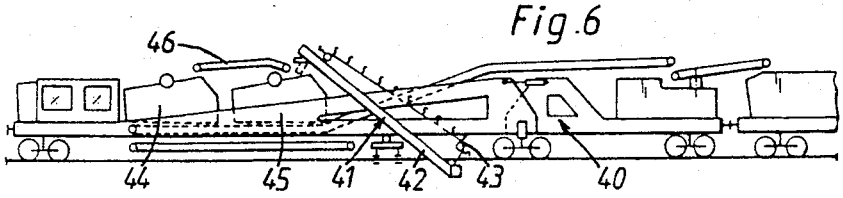

ARRANGEMENT FOR EXCAVATING AND CONVEYING BULK MATERIAL

The present invention relates to an arrangement for excavating bulk material and for conveying the excavated bulk material, which comprises an endless excavating and conveying chain vertically adjustably mounted on a frame of a track maintenance machine, a polygonal guide for the chain, the guide including a transverse section operational below the track, an ascending longitudinal section leading from the transverse section, the transverse and ascending sections forming a transition zone, and a descending longitudinal section leading to the transverse section, and a drive for driving the endless chain in the polygonal guide.

U.S. Pat. No. 4,043,398, dated Aug. 23, 1977, discloses such an arrangement in a mobile ballast cleaning machine. The guide for the endless chain is triangular and the transverse guide section is adjustable to selected lengths for a corresponding change in the width of the ballast excavation, for example in track switches. This type of ballast cleaning machine has been used very successfully but the capacity of the ballast excavating and conveying chain is sometimes insufficient to take care of the amount of ballast being excavated and removed from the ballast bed, particularly in beds of substantial depth, so that the operating speed of the machine must be reduced.

U.S. Pat. No. 4,152,989, dated May 8, 1979, discloses a pentagonal ballast excavating and conveying arrangement in a track renewal train wherein new ties are passed in a path through the arrangement and are laid on the planed ballast bed. The ballast excavating and conveying arrangement is arranged to move the ballast above the level of the tie support plane to a vibratory screen. Space economy requires the arrangement to be relatively small and the conveying capacity is correspondingly limited.

British Pat. No. 970,010, published Sept. 16, 1962, discloses an apparatus for the renewal of the ballast of a railway track, which comprises two ballast cleaning machines coupled in tandem for cleaning the ballast in two successive stages. The first machine has two scraper chains for taking up ballast from the track shoulders and the second machine has an endless excavating and conveying chain for taking up the ballast from underneath the track.

It is the primary object of this invention to provide an arrangement for excavating bulk material, such as ballast, and for conveying the excavated bulk material in a track maintenance machine, such as a ballast cleaning machine, which has all the advantages of the arrangement first described hereinabove but which has a substantially increased conveying capacity.

The above and other objects are accomplished according to the invention with an auxiliary endless excavating and conveying chain associated with the polygonal guide at least in the transition zone, and a separate drive for the auxiliary endless chain.

The arrangement of an additional, independently driven endless chain for conveying the bulk material considerably increases the excavating and conveying capacity of the machine. The auxiliary chain enables any bulk material accumulating particularly in the transition zone between the transverse and ascending sections to be removed promptly, the bulk material tending to become jammed in this zone especially in deep ballast beds and/or if the ballast is mixed with a lot of waste material. In this manner, the load on the main endless excavating and conveying chain is relieved to enable it to pull encrusted ballast out of the bed. The auxiliary endless chain also constitutes an advantageous complementary conveying device for a main excavating and conveying chain equippped with scraper fingers designed primarily for pulling encrusted ballast out of the bed. With the increased capacity provided by the auxiliary chain, additional amounts of excavated bulk material can be handled without any problems while maintaining the same or even a higher operating speed of the machine and without causing jamming of the bulk material, which impairs the pulling power of the machine. On the other hand, if the amount of excavated bulk material is average, the operating speed of the machine may be considerably increased.

At the same time, there is no need for changing the design of the main endless excavating and conveying chain and its polygonal guide whose transverse section may be adjusted in length for operation in track switches, thus maintaining the advantages of this successfully used machine. In fact, such machines may be readily retrofitted with the auxiliary endless excavating and conveying chain.

The above and other objects, advantages and features of the present invention will become more apparent from the following detailed description of certain now preferred embodiments thereof, taken in conjunction with the accompanying, generally schematic drawing wherein:

FIG. 3 is an enlarged cross section along line III of FIG. 1, the track lifting and ballast planing units being omitted to provide a clearer view of the arrangement;

FIG. 4 is a fragmentary cross section of the arrangement along line IV of FIG. 3;

FIG. 5 is a schematic view of another embodiment of a longitudinal guide for the endless chain, with a sectional view of a guide roller for the endless excavating and conveying chain; and FIG. 6 is a diagrammatic side view of another embodiment of a ballast cleaning machine equipped with the arrangement of the invention.

Figure 1:
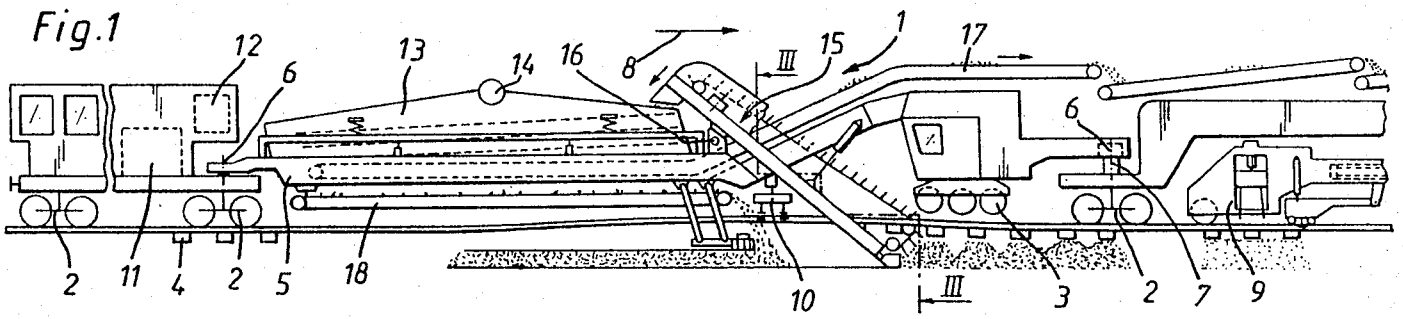
FIG. 1 is a side elevational view of a ballast cleaning machine incorporating a ballast excavating and conveying arrangement according to this invention.
Figure 2:
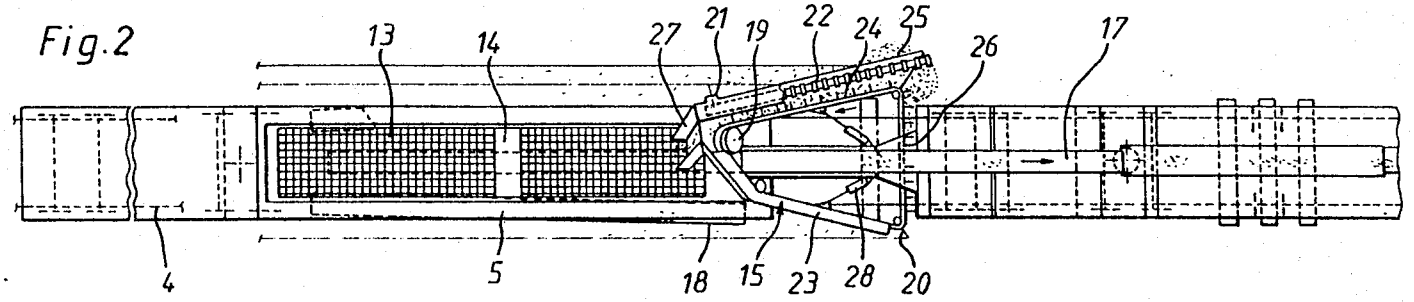
FIG. 2 is a diagrammatic top view of the machine of FIG. 1.

Referring now to the drawing and first to FIGS. 1 and 2, there is shown a track maintenance machine illustrated as ballast cleaning machine 1 which has frame 5 mounted on undercarriages 2 and 3 for mobility on track 4 consisting of rails fastened to ties resting on ballast. The machine frame has a center portion whose respective ends are coupled by pivots 6 to a front and rear portion of the frame, respectively, and power drive 7 at the front end of the frame center portion enables the same to be raised. The operating direction of the ballast cleaning machine is indicated by arrow 8 and track lifting and tamping unit 9 is connected to the front portion of frame 5. The center portion of frame 5 carries track lifting unit 10 for lifting track 4 during the ballast rehabilitation operation and the track is also raised by the lifting tools on unit 9 to avoid undue bending of the track when it is lifted by unit 10. Combined tamping and lifting unit 9 is adjustable in relation to frame 5 in the direction of advancement of the machine so that it may advance discontinuously or stepwise for tamping of successive ties while the ballast cleaning machine advances continuously during the ballast excavating, cleaning and redistributing operations, all of which is conventional. The rear portion of machine frame 5 carries power plant 11, including conventionally the energy supply, drive and transmission means, and control arrangement 12 for operation of the machine.

Elongated and correspondingly high-capacity vibratory screen 13 is mounted on the center portion of frame 5 and this screen comprises three superimposed sieves. Vibrating drive 14 is connected to the screen to impart linear oscillations thereto. Suitable shock absorbers mount the screen on the frame to damp the oscillations and power-driven adjustment drives are connected to the screen for pivoting the same about an axis extending in the direction of elongation of the machine frame so that the screen may be held in a horizontal position in superelevated track sections, i.e. in curves. Waste material coneyor arrangement 17 consisting of a succession of conveyor bands extends from vibratory screen 13 to waste material carrying box cars coupled to ballast cleaning machine 1 forwardly thereof (and not shown) so that waste material separated from the ballast on screen 13 may be conveyed away from the machine. The cleaned ballast is redistributed by two ballast discharge conveyor bands 18 mounted below the screen at the sides of the machine frame and pivotal in a horizontal plane for distributing the cleaned ballast over the width of the track bed. A vertically adjustable and laterially pivotal ballast planing device is mounted on the machine frame behind the discharge range of conveyor bands 18, in the operating direction, to enable the redistributed cleaned ballast to be planed. All of the above structure may be entirely conventional and their operation is well known.

Arrangement 15 for excavating bulk material (which is constituted by ballast and waste material encrusting the same in the illustrated embodiment) and for conveying the excavated bulk material comprises main endless excavating and conveying chain 20 vertically adjustably mounted on frame 5. The illustrated polygonal guide for chain 20 is quadrilateral and includes transverse section 26 operational below track 4, ascending longitudinal section 25 receiving ascending chain section 24 and leading from the transverse guide section, the transverse and ascending guide sections 26, 25 forming a transition zone interconnecting the two sections, and descending longitudinal guide section 23 leading to transverse guide section 26. The descending longitudinal guide section is comprised of two parts enclosing an obtuse angle with each other. Power drive 19 drives endless chain 20 in the polygonal guide. All of this structure may also be essentially conventional.

According to the present invention, auxiliary endless excavating and conveying chain 22 is associated with the polygonal guide at least in the transition zone between transverse guide section 26 and ascending guide section 25, and the auxiliary endless chain has separate drive 21. In the illustrated embodiment, auxiliary endless excavating and conveying chain 22 extends substantially parallel to, and has substantially the same length as, ascending longitudinal section 25 of the polygonal guide. The main and auxiliary endless chains are driven in the same direction. This provides a compact unit and the unidirectional movement of the two conveying chains assures that the two chains will not interfere with each other's conveying operation so that the capacity of the apparatus is further enhanced. With the two chains being of substantially equal length, the two portions of the conveyed bulk material may be discharged at the same point whereby the structure for the further transport of the bulk material may be greatly simplified. As shown, the main and auxiliary endless excavating and conveying chains have ascending portions leading to an outlet for the conveyed material and common chute 27 leads from this outlet to an inlet of vibratory screen 13. In this manner, the conveyed bulk material is immediately discharged at the upper ends of the ascending chain portions and directly delivered to the vibratory screen for cleaning, thus enabling the apparatus to handle considerable amounts of bulk material without any problem.

Common pivot 16 vertically adjustably mounts main and auxiliary endless chains 20, 22 on frame 5 and power drive means constituted by power drives 28 linking the polygonal guide to the frame vertically adjust the chains in unison. When arrangement 15 is pivoted to the frame in the range of its upper end, even a small pivoting movement will effectively adjust the vertical level of the opposite end of the arrangement where the bulk material is excavated. In addition, the oblique positioning of excavating and conveying chain arrangement 15 assures a favorable transmission of the forces opposed to the forward movement of the machine and enhanced by the conveying movement of the auxiliary chain through common pivot 16 to machine frame 5.

The center portion of machine frame 5 is comprised of two carrier beams spaced from each other to receive vibratory screen 13 and a center carrier beam connected to the two lateral beams in the range of pivot 16 and extending forwardly through excavating and conveying chain arrangement 15. In the machine herein described, all the power drives are hydraulic drives.

As seen in the end view of FIG. 3, main endless excavating and conveying chain 20 is driven in a first plane extending in the direction of elongation of machine frame 5 obliquely to the frame while auxiliary endless chain 22 is driven in a second plane substantially perpendicularly to the first plane. The ascending longitudinal section of the polygonal guide is common channel-shaped guide 25 for ascending portions 24 and 29 of the main and auxiliary endless excavating and conveying chains 20 and 22 whereby the main and auxiliary chains form a unit for common vertical and pivotal adjustment on machine frame 5. With this arrangement, the width of the conventional excavating and conveying chain arrangement need be increased only a little. The relatively large inlet opening of the common channel-shaped guide provides a common conveyance path for the simple and prompt feeding of the bulk material excavated from the ballast bed and tending to jam at 31 at the transition zone between transverse guide section 26 and ascending guide section 25. Only a single pivoting means is needed for the vertical adjustment of the main and auxiliary endless chains since they form a structural unit.

Guide section 25 has an enlarged portion accommodating auxiliary endless chain 22 trained over two lower guide rollers 30, 30 spaced apart and forming oblique portion 34 of the auxiliary endless and conveying chain (see FIG. 4), and upper guide roller 30 preceding the lower guide rollers in the direction of movement of the chain. Ascending portion 29 of the chain leads from the oblique portion to the upper guide roller, and separate drive 21 is arranged at an upper end of the chain. With this special guiding arrangement of the auxiliary chain before the start of the ascending chain portion, an advantageous inlet is provided for the bulk material since the chain is introduced gradually into the jammed material at 31 under a small angle. This prevents a sudden impact on the chain members as they are immersed in the bulk material and thus not only increases their operating life but also assures that a larger amount of the material is entrained.

As can be seen in FIG. 3, transverse guide section 26 of the polygonal guide for the main ballast excavating and conveying chain is obliquely inclined in relation to the track plane to obtain the required superelevation of the sub-grade for a two-track ballast bed. As is conventional, endless excavating and conveying chain 20 comprises scraper fingers of wear-resistant material and is trained over guide pulleys for movement in the polygonal guide. FIG. 3 shows the elongated center carrier of machine frame 5, which passes through excavating and conveying arrangement 15, in section while the two lateral carrier portions of the frame are seen in end view.

In the embodiment of auxiliary ballast excavating and conveying chain 22 shown in FIG. 4, the chain comprises guide chain 32 driven by separate drive 21 (FIG. 3) and trained over guide rollers 30, and scoop-shaped conveying members 33 affixed to the guide chain. These scoop-shaped members will entrain ballast 31 accumulating at the transition zone between the transverse and ascending sections of the polygonal guide to convey it along ascending section 29 of auxiliary chain 22, the scoop-shaped members being successively immersed in the ballast along an oblique path defined by chain portion 34 between the two lower guide rollers 30, 30. This arrangement assures a very high conveying capacity of the auxiliary chain for excavating and conveying the ballast previously loosened by the main excavating chain along transverse section 26 and jammed at 31.

FIG. 5 fragmentarily illustrates an embodiment of an excavating and conveying chain arrangement 35 which comprises separate elongated guide 38 for auxiliary endless excavating and conveying chain 39, longitudinal section 37 of the polygonal guide for main endless excavating and conveying chain 36 being also shown in the drawing. In this embodiment, the auxiliary chain is vertically and pivotally adjustable independently of the main chain, suitable and independent pivoting means being connected to the polygonal guide of the main chain and separate guide 38 for the auxiliary chain. This embodiment is particularly useful for retrofitting an existing machine with the auxiliary excavating and conveying chain of this invention. Furthermore, the independent mountings of the main and auxiliary chains make it possible to position the two chains independently of each other to adapt the arrangement optimally to the prevailing operating conditions. In addition, the auxiliary chain may be operated at a higher speed than the main chain to increase the conveying capacity of the auxiliary chain when needed, for example if especially large amounts of bulk material become jammed at the transition zone. Therefore, this embodiment may be readily adapted to sudden changes in the amount of bulk material excavated and conveyed by the main chain.

FIG. 6 illustrates ballast cleaning machine 40 comprising two vibratory screens 44, 45 mounted on the machine frame sequentially in the direction of elongation of the machine. The two screens are operable independently of each other and are arranged behind ballast excavating and conveying arrangement 41 in an operating direction of the machine along the track, arrangement 41 being comprised of main and auxiliary excavating and conveying chains 42, 43. Arrangement 41 may take any of the forms described hereinabove. Conveyor 46 is mounted on the machine frame and is selectively operable to connect a selected one of chains 42, 43 to a selected one of screens 44, 45. A pivotal chute is arranged to transport bulk material from a selected one of the excavating and conveying chains either to the inlet of screen 45 or to conveyor 46 for conveying the material to the inlet of screen 44. This embodiment has the great advantage that the increased conveying capacity is matched by an increased screening, i.e. cleaning, capacity for the excavated ballast so that the excavating and conveying chains may be operated at their highest capacity and their speed need not be adjusted to the capacity of a single screen receiving the bulk material for cleaning. The selective operation of the conveyor makes it possible economically to transport the material to the second screen in case of need.

The illustrated and hereinabove described arrangement for excavating bulk material and for conveying the excavated bulk material operates in the following manner:

Retractible undercarriage 3 is used only for moving the track maintenance machine from one to another operating site. When the machine arrives at an operating site, power drive 6 is operated to lift undercarriage 3 so that the machine is supported solely by undercarriages 2 during its operation. At this site, a transverse channel is dug in the ballast under the track and transverse section 26 of the polygonal chain guide is positioned in this channel. Lifting unit 10 is operated to raise track 4 and the machine is driven forward in the direction of arrow 8 while drives 19 and 21 are actuated to drive main and auxiliary endless ballast excavating and conveying chains 20 and 22 to move the excavated ballast to screen 13 for cleaning, drive 14 being actuated to vibrate the screen. The chains are driven counterclockwise to excavate the ballast from under the track, the scraper fingers on main chain 20 projecting into the encrusted ballast and tearing the ballast out of the bed during the conveying movement of the chain to convey the excavated material along transverse guide section 26 to a transition zone between this guide section and longitudinal guide section 25. At this point, the chain is guided about a guide roller and takes an ascending path enclosing an obtuse angle with the transverse section so that a portion of the excavated bulk material is forced out of the conveying path and forms a heap, as shown at 31 in the drawing. The remainder of the bulk material is conveyed by the main chain to chute 27 which discharges it into the vibratory screen. As best shown in FIGS. 3 and 4, the displaced bulk material at 31 is received by the auxiliary chain and is conveyed along ascending section 29 of auxiliary chain 22 to the chute. Thus, the entire excavated bulk material is efficiently conveyed to the cleaning screen while the machine continuously advances in the direction of arrow 8. The cleaned ballast is redistributed to the track bed and the ballast is tamped under successive track ties in intermittent steps, for which purpose track tamping and lifting unit 9 is displaced synchronously with the continuous advancement of the machine so that it may be operated intermittently at each tie. Such an arrangement has been more fully disclosed and claimed in copending application Ser. No. 498,261, filed May 26, 1983.

What is claimed is:

1. An arrangement for excavating bulk material and for conveying the excavated bulk material, which comprises (a) a main endless excavating and conveying chain vertically adjustably mounted on a frame of a track maintenance machine and driven in a first plane, (b) a polygonal guide for the chain, the guide including (1) a transverse section operational below the track, (2) an ascending longitudinal section leading from the transverse section, the transverse and ascending sections forming a transition zone, and (3) a descending longitudinal section leading to the transverse section, (c) a drive for driving the endless chain in the polygonal guide, (d) an auxiliary endless excavating and conveying chain associated with the polygonal guide at least in the transition zone and driven in a second plane substantially perpendicular to the first plane, (1) the ascending longitudinal section of the polygonal guide being a common channel-shaped guide for ascending portions of the main and auxiliary endless excavating and conveying chains whereby the main and auxiliary chains form a unit for common vertical and pivotal adjustment on the machine frame, and (e) a separate drive for the auxiliary endless chain.

2. A ballast cleaning machine comprising an arrangement for excavating ballast from underneath a track and for conveying the excavated ballast, which comprises (a) a main endless excavating and conveying chain vertically adjustably mounted on a frame of the machine, (b) a polygonal guide for the chain, the guide including (1) a transverse section extending and operational below the track, (2) an ascending longitudinal section leading from the transverse section, the transverse and ascending sections forming a transition zone, and (3) a descending longitudinal section leading to the transverse section, (c) a drive for driving the endless chain in the polygonal guide, (d) an auxiliary endless excavating and conveying chain associated with the polygonal guide at least in the transition zone, and (e) a separate drive for the auxiliary endless chain.

3. The ballast cleaning machine of claim 2, wherein the main endless excavating and conveying chain is driven in a first plane and the auxiliary chain is driven in a second plane substantially perpendicular to the first plane.

4. The arrangement of claim 2, wherein the auxiliary endless excavating and conveying chain extends laterally adjacent, substantially parallel to, and has substantially the same length as, the ascending longitudinal section of the polygonal guide.

5. The arrangement of claim 2, wherein the auxiliary endless excavating and conveying chain comprises a guide chain driven by the separate drive, guide rollers over which the guide chain is trained, and scoop-shaped conveying members affixed to the guide chain.

6. The arrangement of claim 5, wherein the guide rollers comprise two lower guide rollers, the two guide rollers being spaced apart and forming an oblique portion of the auxiliary endless excavating and conveying chain, and an upper guide roller preceding the lower guide rollers in the direction of movement of the chain, an ascending portion of the chain leading from the oblique portion to the upper guide roller, and the separate drive is arranged at an upper end of the chain.

7. A ballast cleaning machine comprising the arrangement of claim 2, further comprising a common pivot vertically adjustably mounting the main and auxiliary endless chains on the frame, and power drive means for vertically adjusting the chains in unison.

8. The ballast cleaning machine of claim 7, further comprising a vibratory screen mounted on the frame, the screen having an inlet for the bulk material, the main and auxiliary endless excavating and conveying chains having ascending portions leading to an outlet for the conveyed bulk material, and a common chute leading from the outlet to the inlet.

9. A ballast cleaning machine comprising the arrangement of claim 2, further comprising a separate elongated guide for the auxiliary endless excavating and conveying chain.

10. A ballast cleaning machine comprising an arrangement for excavating ballast from underneath a track and for conveying the excavated ballast, which comprises (a) a main endless excavating and conveying chain vertically adjustably mounted on a frame of the machine, (b) a polygonal guide for the chain, the guide including (1) a transverse section extending and operational below the track, (2) an ascending longitudinal section leading from the transverse section, the transverse and ascending sections forming a transistion zone, and (3) a descending longitudinal section leading to the transverse section, (c) a drive for driving the endless chain in the polygonal guide, (d) an auxiliary endless excavating and conveying chain associated with the polygonal guide at least in the transition zone, (e) a separate drive for the auxiliary endless chain, (f) a common pivot vertically adjustably mounting the main and auxiliary endless chains on the frame, (g) power drive means for vertically adjusting the chains in unison, (h) two vibratory screens mounted on the frame sequentially in the direction of elongation of the machine, the two screens being operable independently of each other and being arranged behind the main and auxiliary excavating and conveying chains in an operating direction of the machine along the track, and (i) a conveyor selectively operable to connect a selected one of the chains to a selected one of the screens.

* * * * *